US006095313A

United States Patent [19]

Molbak et al.

[11] Patent Number: 6,095,313

[45] **Date of Patent: *Aug. 1, 2000**

[54] COIN COUNTER DEJAMMING METHOD AND APPARATUS

[75] Inventors: Jens H. Molbak; Dan Gerrity, both of Bellevue; Scott Scherer; Aaron R. Finch, both of Seattle, all of Wash.

[73] Assignee: Coinstar, Inc., Bellevue, Wash.

[ * ] Notice: This patent is subject to a terminal disclaimer.

[21] Appl. No.: 09/349,637

[22] Filed: Jul. 8, 1999

Related U.S. Application Data

[63] Continuation of application No. 09/019,265, Feb. 5, 1998, Pat. No. 5,957,262, which is a continuation of application No. 08/431,070, Apr. 27, 1995, Pat. No. 5,746,299.

[51] Int. Cl.[7] ..... G07F 1/04

[52] U.S. Cl. ..... 194/344

[58] Field of Search ..... 194/344, 348, 194/349

[56] References Cited

U.S. PATENT DOCUMENTS

| | | | |
|---|---|---|---|
| 446,303 | 2/1891 | Thompson . | |
| 2,865,561 | 12/1958 | Rosapepe | 232/7 |
| 3,065,467 | 11/1962 | Prevost | 346/22 |
| 3,132,654 | 5/1964 | Adams . | |
| 3,173,742 | 3/1965 | Simjian | 346/22 |

(List continued on next page.)

FOREIGN PATENT DOCUMENTS

| | | | |
|---|---|---|---|
| 2060630 | 7/1992 | Canada | G06F 15/24 |
| 2067987 | 7/1992 | Canada | G06F 15/21 |
| 25 28 735 | 4/1976 | Germany | B60K 17/10 |
| 30 21 327 | 12/1981 | Germany | B60K 17/10 |
| 3-92994 | 4/1991 | Japan | G07D 9/00 |
| 4-33194 | 2/1992 | Japan | 194/348 |
| 93/07846 | 4/1994 | WIPO | G06F 15/16 |

OTHER PUBLICATIONS

Hamilton, *Turning Cans Into Cold Cash, The Washington Post*, Jul. 21, 1991, pp. D1 and D4, 194–209.

*Slide Changing Apparatus With Slide Jam Protection*, Research Disclosure 30509, Sep. 1989.

Reis Eurosystems, *Operating Instructions CS 3110 Selectronic coin sorting and counting machine with Central Sensor*, Jul. 1992, pp. 1–12, I–IV.

Reis Eurosystems Geldbearbeitungssysteme, *Test–Programme CS 3110 Selectronic coin sorting and counting machine*, Jul. 1992, pp. 1–3.

F. Zimmerman & Co., *Reference Manual Contovit/Sortovit, Perconta money Counting and Sorting Systems*, Aug. 1995, pp. I–III, 1–31 and three pages of specifications.

*Primary Examiner*—F. J. Bartuska

*Attorney, Agent, or Firm*—Sheridan Ross, P.C.

[57] ABSTRACT

An automatic response to a detected jam or other slowing or stoppage in a coin handler, such as a coin counter and/or sorter, is provided. Such automatic dejamming is particularly useful for unattended operation of coin handlers. Preferably the response is substantially flexible, such as by providing different responses depending on the type of jam and/or the history of jamming. In one embodiment, potential responses include initiating a wait period, providing mechanical energy (such as causing vibration by controllably activating transducers, preferably addressable transducers which perform a second function in the apparatus), and/or impact. When the coin handler uses a rail mechanism, reliable, reduced-jam operation is enhanced by a ribbed rail structure that reduces or minimized the amount of surface area in contact with the coin face, consistent with providing the support desired for assuring accurate counting. Preferably the ribs are relatively deep, and have a rounded profile.

25 Claims, 7 Drawing Sheets

U.S. PATENT DOCUMENTS 3,603,327 9/1971 Buchholz et al. .
3,815,717 6/1974 Arserieau .
4,036,242 7/1977 Breitenstein et al. .
4,058,954 11/1977 Asami ..... 53/54
4,059,122 11/1977 Kinoshita .
4,092,990 6/1978 Bayne ..... 453/55
4,099,722 7/1978 Rodesch et al. ..... 273/143 R
4,100,925 7/1978 Fukunaga .
4,106,610 8/1978 Heiman .
4,167,949 9/1979 Hashimoto et al. .
4,228,811 10/1980 Nakajima et al. .
4,249,552 2/1981 Margolin .
4,266,121 5/1981 Hirose ..... 235/381
4,306,644 12/1981 Rockola et al. ..... 194/348
4,356,829 11/1982 Furuya .
4,360,034 11/1982 Davila et al. .
4,369,800 1/1983 Watanabe et al. .
4,380,316 4/1983 Glinka et al. ..... 232/16
4,383,540 5/1983 De Meyer et al. .
4,398,550 8/1983 Shireman .
4,434,359 2/1984 Wantanabe ..... 235/379
4,503,963 3/1985 Steiner .
4,558,711 12/1985 Yoshiaki et al. .
4,598,378 7/1986 Giacomo .
4,611,205 9/1986 Eglise ..... 340/825.35
4,622,456 11/1986 Naruto et al. ..... 235/379
4,706,577 11/1987 Jones ..... 109/59 T
4,716,799 1/1988 Hartmann ..... 83/42
4,723,212 2/1988 Mindrum et al. ..... 364/401
4,753,625 6/1988 Okada ..... 453/32
4,883,158 11/1989 Kobayashi et al. ..... 194/217
4,910,672 3/1990 Off et al. ..... 364/405
4,921,463 5/1990 Primdahl et al. ..... 453/3
4,936,436 6/1990 Keltner ..... 194/318
4,953,086 8/1990 Fukatsu ..... 364/408
4,978,322 12/1990 Paulsen ..... 453/57
4,995,848 2/1991 Goh ..... 453/3
4,997,406 3/1991 Horigitchi et al. ..... 453/57
5,021,967 6/1991 Smith ..... 364/479
5,025,139 6/1991 Halliburton, Jr. ..... 235/379
5,039,848 8/1991 Stoken ..... 235/381
5,091,713 2/1992 Home et al. ..... 340/541
5,098,339 3/1992 Dabrowski ..... 453/30
5,173,851 12/1992 Off et al. ..... 364/401
5,219,059 6/1993 Furuya et al. ..... 194/200
5,299,673 4/1994 Wu ..... 194/345
5,316,120 5/1994 Ibarrola ..... 194/318
5,321,242 6/1994 Heath, Jr. ..... 235/382
5,388,680 2/1995 Hird et al. ..... 194/345
5,449,058 9/1995 Kotler et al. ..... 194/344

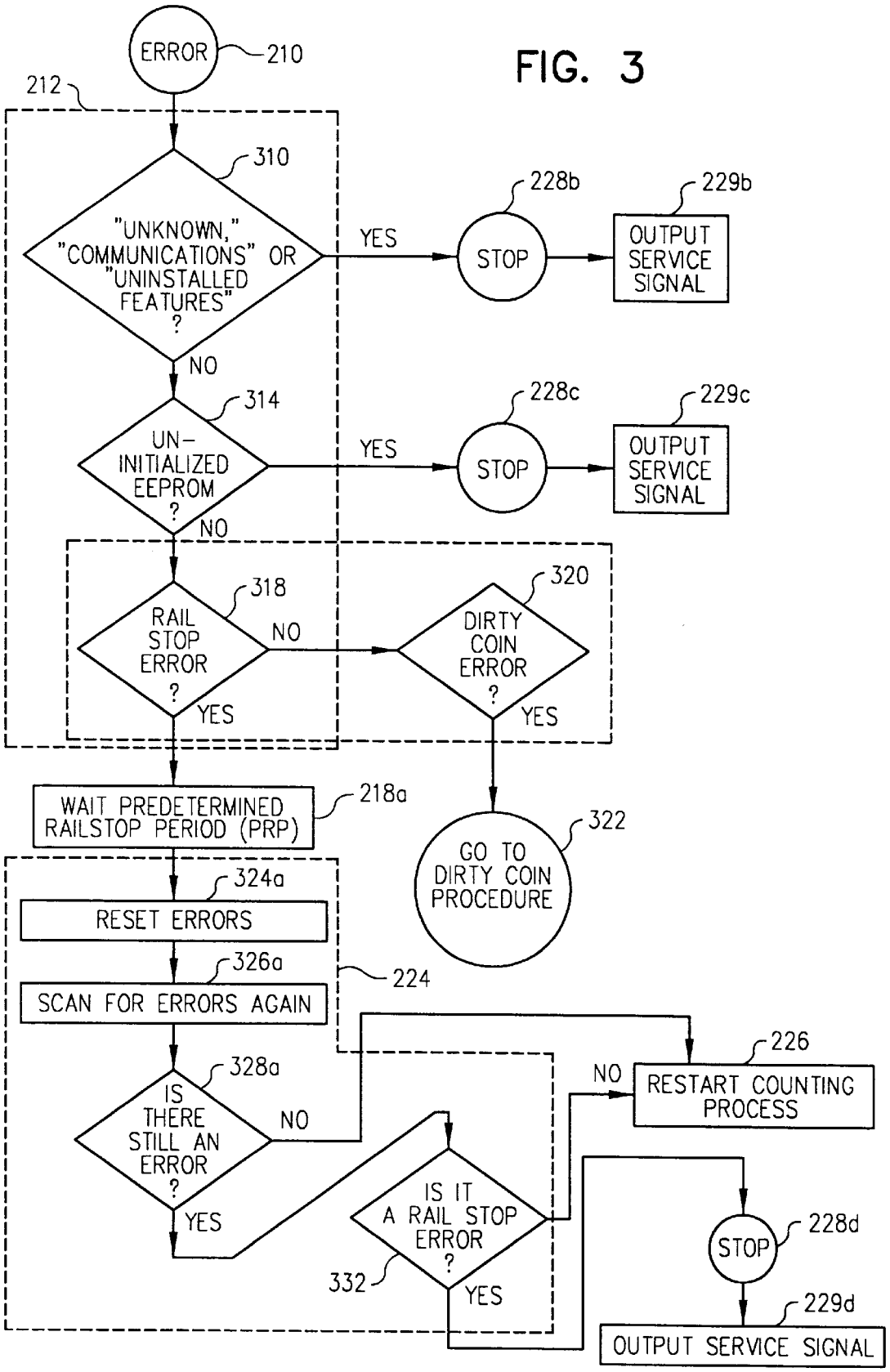
FIG. 3
ERROR
210
212
310
"UNKNOWN," "COMMUNICATIONS" OR "UNINSTALLED FEATURES" ?
YES
228b
STOP
229b
OUTPUT SERVICE SIGNAL
NO
314
UN-INITIALIZED EEPROM ?
YES
228c
STOP
229c
OUTPUT SERVICE SIGNAL
NO
318
RAIL STOP ERROR ?
NO
YES
320
DIRTY COIN ERROR ?
YES
WAIT PREDETERMINED RAILSTOP PERIOD (PRP)
218a
322
GO TO DIRTY COIN PROCEDURE
324a
RESET ERRORS
326a
SCAN FOR ERRORS AGAIN
224
328a
IS THERE STILL AN ERROR ?
NO
YES
226
NO
RESTART COUNTING PROCESS
IS IT A RAIL STOP ERROR ?
332
YES
STOP
228d
229d
OUTPUT SERVICE SIGNAL 358
BLOCKED OR SLOW COIN ?
NO
YES
218b
WAIT PREDETERMINED TIME (PT)
324b
ISSUE "RESET ERRORS" (RE)
326b
ISSUE "SCAN FOR ERRORS" (TC)
328b
TC = 0 ?
NO
YES
374b
ISSUE ASK ERROR (AE)
376
ISSUE "DO VIBRATE" (DV)
378
WAIT DV TIME
324c
ISSUE RESET ERRORS (RE)
326c
ISSUE SCAN FOR ERRORS (TC)
219
328c
TC = 0 ?
YES
NO
366
ISSUE "DO COUNT" (DC)
368
SET RUN = PRN+1

COIN COUNTER DEJAMMING METHOD AND APPARATUS

This is a continuation of application Ser. No. 09/019,265, filed Feb. 5, 1998 now U.S. Pat. No. 5,957,262, which is a continuation of application Ser. No. 08/431,070, filed on Apr. 27, 1995, now U.S. Pat. No. 5,746,299, which are incorporated herein by reference.

The present invention relates to automatic correction of certain errors in a coin handler and, in particular to correcting certain interruptions or slow-downs of coin flow in a coin counter to reduce or avoid the need for manual intervention.

BACKGROUND INFORMATION

This invention relates to a method and apparatus for controlling a coin sorting and counting machine for use in an unattended and highly reliable mode by the general public and for those without special training or knowledge. In a conventional coin sorting and counting machine of this type mixed coins loaded therein are sorted e.g. according to the differences in diameter and the coins thus sorted are counted while the machine is being attended to by a trained operator. Conventional machines sometimes have coin jam detecting devices that automatically shut the machine down and stop the operation; typically, the operator is required to manually intervene and clear the jam, stoppage or failure. The speed of conventional machines for coin counting and sorting have been accepted as being necessarily slow because accuracy of the machines was considered paramount and the slow speed was considered necessary for such accuracy. Since these machines would stop upon a jam and not continue, operators would intervene to restart and clear a machine rather than risk a miscount. The present invention has been designed to be accurate while being a high speed machine that clears lams and stoppages itself without out the need for a special operator. In general, it is often a troublesome slow moving coin that jams the conventional machines. The present invention has overcome the difficulties posed by slow moving coins that may create or cause a machine to indicate a jam. The invention senses jams and slow moving coins and then causes these coins to continue moving or to be cleared from the path of other coins. A significant increase in the reliability and processing capability of coins collected from the public and used in an unattended self-service manner is thus made possible with the resent invention.

SUMMARY OF THE INVENTION

The present invention involves reacting to a detected error in a counting machine by taking measures to dejam the machine. As used herein, a "jam" in the context of coin handling, refers to any stopping or slowing of the rate of flow of coins through the processing machinery which extends beyond or drops below a predetermined threshold, and is not limited to only that slowing or stopping which results from wedging of one or more coins in the machinery. Jamming can include, for example, slowing or interruption of coin flow which arises from adhesion or stickiness (between a coin and a machine part or between two or more coins or two or more machine parts). Deformed, corroded, damaged or misshapen coins or machine parts, wedging of one or more coins in a machine part, interaction of a machine part and/or coin with a non-coin item including lint, dirt, sand and other substantially non-metallic materials or objects such as buttons, metallic objects such as paper clips, keys, key rings, rings or other jewelry, screws, nails, staples, foil wrappers and any of a variety of other non-coin metallic objects. Adhesion or stickiness can arise from the presence of a number of substances including lanolin, natural oils produced by the human body or other oils, soft drinks or other beverages or foodstuffs, moisture from dew, condensation or combinations of the above.

By providing for effectively and automatically dejamming at least some types of jams, the present invention reduces or eliminates the need for manual intervention. Self-service coin counting, because of the many difficulties, such as dealing with dirty or misshapen coins, contaminants or foreign objects, often is not attempted. If self-service, unattended coin counting is attempted with conventional equipment it is believed the attempt would be unsuccessful. A remotely located self-dejamming machine can be particularly advantageous when a coin counter is intended for use by the general public, since general public use often involves handling of dirty, misshapen or foreign coins and/or other objects, and since public satisfaction with and confidence in a counting device can be eroded if there is a frequent need for manual intervention, particularly considering the delay that may be involved.

In one embodiment, some or all of the dejamming measures employ transducers or other hardware devices, which serve another purpose in the counting machine. This provides a simplified design since, for some dejamming measures, it is not necessary to add hardware to the device in order to achieve the desired results. Furthermore, since at least some dejamming measures use already-present hardware, at least some embodiments of the invention can be used in connection with an installed base of counting devices, making little or no change in the hardware of such devices. In many coin handling devices, one or more components include an apparatus for converting a first non-mechanical form of energy into a form of mechanical energy, i.e., a transducer. For example, some devices may include one or more solenoids for converting electrical energy into mechanical energy, e.g., redirecting the coins for purposes of sorting or diverting coins.

By using controllable, preferably addressable, hardware within the counting device (either already-present hardware or add-on hardware), the present invention provides for resolving or overcoming many types of errors automatically, i.e. without the need for manual intervention or assistance, e.g. by dedicated personnel or other personnel. Using transducers that are addressable provides the flexibility to controllably activate different transducers in different situations, e.g. to activate different transducers under computer (or other) control depending on the type of jam detected.

In one embodiment of the invention, dejamming measures are used which are not limited to a mere reversal of motion as used by the conventional systems. The present invention, in some embodiments, provides mechanical energy, such as vibration, impact or jostling, and/or initiating a wait period for self clearing, in order to cause a coin to move along the desired pathway. Such measures are useful because they can be used in connection with a wider variety of mechanisms including gravity fed or gravity driven mechanisms which can not readily be reversed.

According to one embodiment of the invention, an automatic evaluation of the results of the dejamming measures is performed. Although the evaluation can be a simple determination of whether the error is still present, in some embodiments a more sophisticated definition of whether the dejamming measures were "successful" is used. In one embodiment the evaluation includes evaluating factors related to the history of jamming and/or dejamming, e.g., so that if a number of errors (or errors of a particular category) are repeated within a predetermined period of time, and/or under predetermined circumstances, the counting process is stopped.

BRIEF DESCRIPTION OF THE DRAWINGS

FIG. 3 is a flow diagram depicting an error handling routine, including a rail stop error routine, according to an embodiment of the present invention;

DETAILED DESCRIPTION OF THE PREFERRED EMBODIMENT

Figure 7:
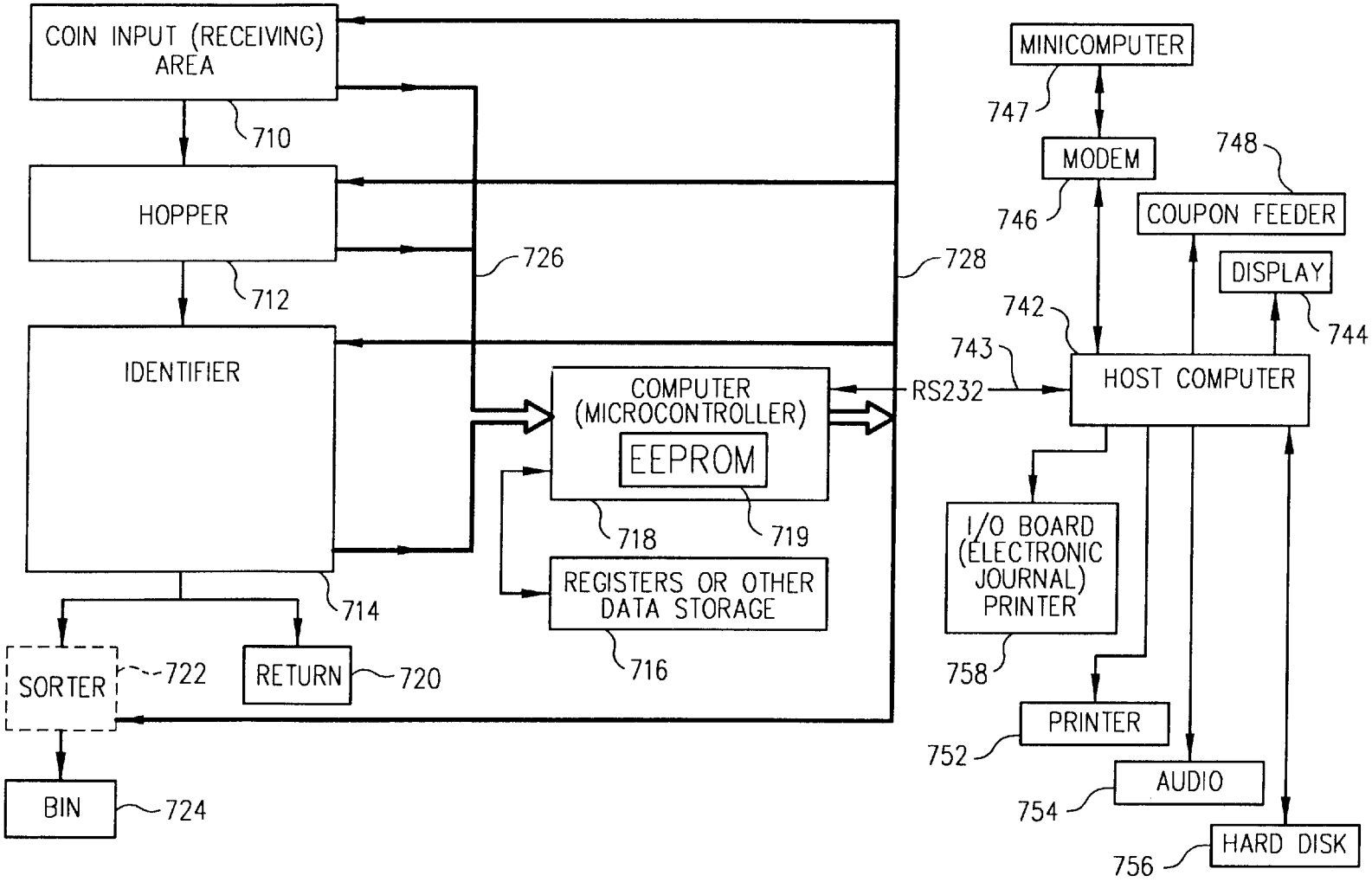
FIG. 7 is a block diagram of a coin counter of a type that can be used in connection with embodiments of the present invention.

FIG. 7 depicts, in overview, the main components of a coin counting device. The device includes an input or receiving area where the user of the device initially positions the coins to be counted 710. Typically, the coins are moved from the receiving area into a hopper 712. The hopper acts as a flow controller for controlling the rate at which coins are sent to an identifier 714. The identifier, as described more thoroughly below, identifies the item which has been received in the identifier, typically by identifying the type of coin (denomination) and providing the information to counter computer 718, e.g., for transmission to host computer 742 and/or storage in a data storage unit 716, which may be an electronic memory such as a mass-memory, buffer memory and/or register which is part of or associated with a counter computer 718. Items received by the identifier which cannot be identified as an acceptable coin or are otherwise defective may be diverted to a separate region such as a return area 720. In some devices, identified coins are sorted by a sorter 722 so that the different denominations are sent to or held by different areas. Ultimately the identified coins are deposited in one or more bins 724. In one embodiment, counter computer 718 receives data from and supplies data and/or commands to some or all of the sorter components 710,712,714,722,724, e.g. via input and output lines 726,728. In one embodiment, the counter computer 718 includes a microcontroller such as Hitachi model 6303. In one embodiment some or all of the programming or other instructions for the counter computer 718 are stored in non-volatile memory such as an electrically erasable programmable read only memory (EEPROM) 719 such as model Am29C256 available from Advanced Micro Devices. The microcontroller or other counter computer 718 which can operate as the on-board coin counting logic may communicate with a host computer 742 such as a personal computer e.g. a 486-type computer. Communication can be over, e.g. an RS232 serial link 743. In this configuration, the host computer 742 and embedded controller 718 operate in a master-slave relationship, in a manner that will be understood by those of skill in the arc upon review of the present disclosure. For example, in one embodiment, the host computer issues commands such as "Do Count" (DC) and "Test Cam" (TC), described more thoroughly below, and the embedded controller 718 performs the appropriate tasks and returns information to the host computer 742. The host computer may be coupled to other devices such as a CRT or other display 744, a modem 746, e.g. for communicating with a central computer, such a minicomputer 747, a coupon dispenser 748, a printer 752, audio output 754, a hard drive or other memory device 756 and/or a input output (I/O) source/sink, such as an I/O board, e.g., for providing an electronic journal 758. These additional devices can be used in a number of fashions, e.g. as described, generally, in U.S. Pat. applications Ser. No. 08/255,539 for Coin Counter/Sorter and Coupon/voucher Dispensing Machine and Method and/or 08/237,486 commonly assigned herewith and incorporated herein by reference.

Although in one embodiment a programmed counter computer 718, provides control signals to the various components, it is also possible to use other devices such as non-software controlled devices, e.g. one or more application specific integrated circuits (ASIC), hardwired logic and the like for controlling the various components. For example, it is possible to implement a hardwired control device by translating software of the type described below into one or more logical expressions consisting only of AND, OR and NOT expressions, and using discrete AND gates, OR gates and NOT gates (inverters) for implementing the desired functionality, in a manner known to those of skill in the art.

Figure 5:
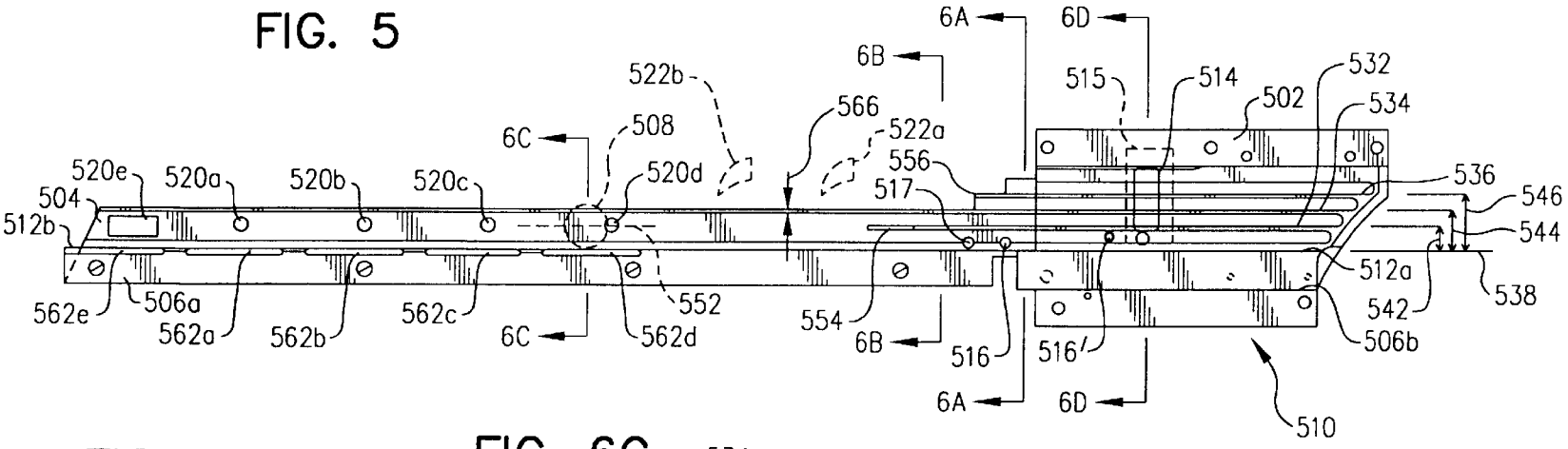
FIG. 5 is a side elevational view of a rail device of a coin counter which can be used in connection with an embodiment of the present invention.

In some devices, coins are conveyed down an inclined rail, introduced thereto by a rotating hopper, e.g., as described in U.S. patent application 08/255,539 and/or U.S. patent application 08/237,486 for Coin Counter/Sort and Coupon/Voucher Dispensing Machine and Method, commonly assigned herewith and incorporated herein by reference. The dejamming methods apparatus described herein are believed to be particularly useful and effective when used in connection with the inclined rail apparatus having one or more of the features depicted in FIG. 5. In the embodiment depicted in FIG. 5, the inclined rail apparatus includes a sensor block 502, a back rail 504, and first and second bottom rails 506*a*, 506*b*. In use, coins are introduced onto the inclined rail from a source such as a rotating hopper (not shown). A coin 508 introduced onto the rail will slide or roll down the upper edge 511 of first the bottom rail 506*b* and then the bottom rail 506*a*, with the flat surface of the coin supported by the back rail 504, as described more fully below, moving from an upper position 512*a* to a lower position 512*b*. In the following, the rail 510 will, in general, refer to the coin contact portions of the inclined coin handling apparatus, including the support surface of the sensor block 502 and associated bottom rail 506*b*, the backrail 504 and associated bottom rail 506*a*. As coins move down the inclined rail, such as under the influence of gravity, they move past various sensing and/or sorting devices. In many coin handling devices, sensors are provided for sensing some or all of a variety of coin characteristics, including, e.g., thickness, diameter, mass, electrical conductivity, magnetic permeability and the like. In the embodiment of FIG. 5, the depicted sensors include a main back sensor 514, main front sensor 515 and X-sensor 516. The sensors provide signals to the counter computer 718 (FIG. 7). The main sensors 514, 515 are capable of discriminating a first type of coin from other coins and/or non-coin objects, and for determining the denomination of at least some of the coins. In one embodiment, the main back sensor 514 operates in cooperation with a front sensor 515, positioned so that coins pass between the front sensor and the rear sensor 515, 514. In one embodiment, the X-sensor 516, which may be, e.g., an optical sensor, can be used to sort U.S. dimes from U.S. pennies rather than relying on knifes which in turn rely on the physical property of diameter. In this way, the combination of sensors 514, 515, and 516 are able to discriminate U.S. coins from other objects, and, in cooperation with counter computer 718, to count the number of each type of coin which passes by the sensors.

In one embodiment, the apparatus is intended to count the coins of various denominations, but not intended to sort the coins, i.e., to deliver different coins to different locations. In such an embodiment, a truncated apparatus, without most of the sorting devices described below, can be used.

For example, it is possible to provide a device that rejects foreign coins or objects using solenoid 516', but does not have any other sorting devices. In the depicted embodiment, however, the apparatus not only counts coins but also performs at least some types of sorting. The most rudimentary type of sorting is to sort U.S. (or other desired) coins from foreign coins and non-coin objects. In the depicted embodiment, solenoid 516', is positioned such that when the detector 514, 515 determines that the object which has passed is not a desired coin, activation of the solenoid 516', e.g. under control of the counter computer 718, will knock the coin off the bottom rail 506*b*, e.g., into a reject bin. As will be apparent to those of skill in the art, other types and/or positions of sensors 514, 515, 516 and/or additional sensors, may be provided for other types of coins, e.g., when the apparatus is intended to count Canadian coins, British coins, French coins, German coins, Japanese coins, and the like. Thus, a first type of sort, sorting desired coins from non-desired coins and other objects, can be performed using solenoid 516'.

A further type of sort can be performed when it is desired to direct coins to different locations, e.g., to fill coin bags or other coin receptacles in order. If desired, this can be achieved or performed without regard to the denomination of the coin, i.e., mixing all denominations in one or more receptacle areas. Solenoids 520*a, b, c, d* and fixed diverter 520*e* are positioned so that, upon activation, the solenoids will divert coins into up to five different coin bags or other locations.

Yet another type of sort positions different coin denominations into different locations. In the depicted embodiment, an "X-solenoid" 517 is positioned to knock the dime off the rail into a dime bag or other dime collection area, under control of the counter computer 718 and in response to detection of a dime by X-sensor 516. Knives 522*a*, 522*b*, are positioned at respective heights above the upper surface 511, so as to divert coins of a predetermined diameter off the rail and into, e.g., a quarter bag and a nickel bag, respectively. In the depicted embodiment, since dimes are diverted at location 517, quarters are diverted at location 522*a*, and nickels are diverted at location 522*b*, and non-U.S. coins and other objects are diverted at location 516', any coins reaching solenoids 520*a* through 520*d*, or fixed diverter 520*e* will be pennies. Thus, in the depicted embodiment. solenoids 520*a* through 520*d* can be used to divert pennies into up to four different penny bags, and by relaxing all solenoids 520*a* through 520*d* pennies can be diverted into a fifth bag by the fixed diverter 520*e*. Diverter 520*e* can be wedge shaped and is preferably sanded or otherwise made substantially smoother to avoid undesirable interaction with nicks; burrs, or other coin irregularities. Although it is possible to use a properly-placed knife (similar to knives 522*a*,522*b*) to divert pennies at the end of the rail 510, using the fixed diverter is believed to contribute to a lower number of jams or other errors.

A number of solenoids can be used in the depicted rail device. In one embodiment, the rail device employs miniature tubular solenoids, such as models TSP, actuated, e.g., by mini-solenoid actuators, e.g., of the SP series, both available from Electro Mechanisms, Inc., of San Dimas, Calif.

Figure 6D:
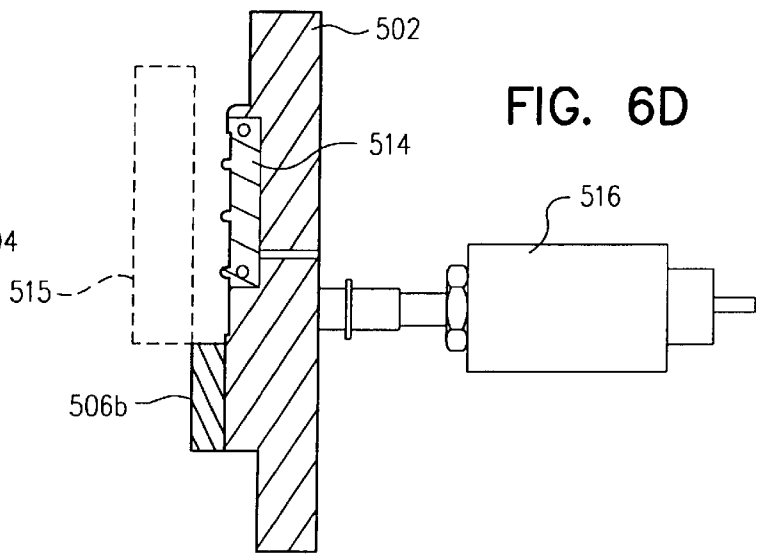
FIGS. 6A,B,C,D are cross sections taken through lines 6A—6A, 6B—6B, 6C—6C and 6D—6D, respectively.
Figure 6C:
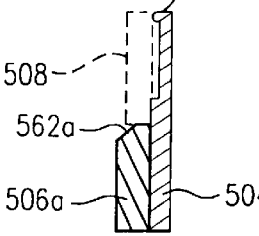
Figure 6B:
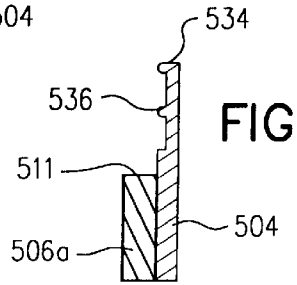
Figure 6A:
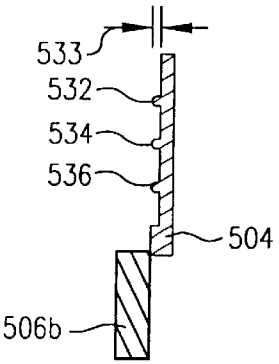

A number of features of the embodiment depicted in. FIG. 5 contribute to the improved performance of the present inventions. In some previous devices, the back rail surface 504 supporting the face of the coins, was substantially flat or contained shallow grooves, leaving a large portion of the coin face in contact with the support surface. In the embodiment of FIG. 5, one or more ribs 532, 534, 536, are formed in the sensor block 502 and/or back rail 504. As depicted in FIG. 6D, the front surface of the main back sensor 514 is provided with ribs substantially matching ribs 532, 534 and 536, so as to provide the substantially uninterrupted ribbing pattern, as coins move past the sensor 514. It is particularly useful to provide sufficient support for the coins in the region of the sensors (especially when, as is typically, the coins are moving relatively quickly past the sensor) since, for many types of sensors, wobble or other irregularities in the attitude of the coins as they move past the sensor can lead to an improper reject and/or a miscount.

By using ribbing such as that depicted in FIGS. 5 and 6A–D, the amount of surface area in contact with the face of the coin is reduced. Preferably, the amount of surface area in contact with the face is reduced to the minimum which still provides sufficient support for the coins. The position of ribs 532, 534, 536 with respect to the level 538 of the upper surface 511 of the bottom rail 506*a*, 506*b*, can be selected in consideration of the diameters of the coins to be handled. In the depicted embodiment, which is intended to handle U.S. quarters, nickels, pennies and dimes, the height or distance 542 of the dime support rib from the bottom rail level 538 is about 0.35 inches (about 0.9 centimeters), the height 544 of the penny rib 534 is about 0.5 inches (about 1.3 centimeters). Preferably the height 546 of the nickel/quarter rib 534 is about 0.8 inches (about 2.2 centimeters). The heights of these ribs above the level 538 can be selected empirically if desired. However, according to one aspect of the invention, the heights of the ribs are selected, with respect to the coin each is designed to support for its major length, to be above the center line 552 of the respective supported coin 508, preferably substantially above the center line, such as more than halfway from the center line to the upper edge of the coin and, more preferably, substantially near the edge of the coin. In this way, the rib provides the desired support for the coin, yet contacts only a relatively small portion of the surface area of the face of the coin (since a chord inscribed near an edge of a circle is shorter than, e.g., the diameter of a circle). In one embodiment, the rib is as far as possible from the surface 538 while still providing the desired support for the coin, and accommodating coin wear or other factors that may affect the effective coin diameter. In one embodiment, less than two-thirds of the total surface area of the penny is in contact with the rail over the major part of the travel of the penny down the rail, preferably less than half an more preferably, about one-fifth or less. Different ratios will apply to different denominations, but preferably less than about one-half (preferably less than about one quarter) of each denomination's face surface area in contact with the rail.

Another feature of the ribs 532, 534, 536 in the embodiment of FIG. 5 is that the ribs extend, longitudinally, only that distance needed to perform the desired function. For example, since solenoid 517 will divert dimes off the rail, the dime rib 532 can be tapered off or otherwise terminated 554 downstream of the solenoid 517. After the coins have passed sensor 514, where the stability provides for counting accuracy, the nickel/quarter rib 536 can be terminated 556, since the penny rib 524 can provide the necessary support, albeit at a location which is not as nearly adjacent the coin edge as the nickel/quarter rib 536. Preferably, the nickel/quarter rib 536 extends somewhat past the sensor block and is provided on at least a portion of the back rail to assist in the successful transition of coins between the sensor block 502 and the back rail 504.

In one embodiment, the ribs are relatively deep, so as to define a relatively large volume in which moisture, dirt or other items can accumulate. Although some moisture or debris may fall, wick or otherwise migrate from the rail area, in may cases, a certain amount of moisture and/or debris will accumulate in the spaces between the ribs. By providing a relatively large volume for such accumulation, it is possible to operate the rail for a relatively long period before the rail must be cleaned, replaced or otherwise maintained. In one embodiment, the rib depth 533 is greater than about 0.005 inches (about 0.13 mm), preferably greater than about 0.01 inches (about 0.25 mm), more preferably greater than about 0.02 inches (about 0.5 mm) and even more preferably about 0.045 inches (about 1.2 mm) or more.

Another feature of the embodiment of FIG. 5 relates to the shape of the upper surface 511 of the lower rail 506*a*. In the depicted embodiment, beveled surfaces 562*a*, 562*b*, 562*c*, 562*d* are formed on the outer edge of the lower rail 506*a* in the vicinity of the solenoid 520*a* through 520*d*. The bevels 562 assist in removing the coins 508 from the rail in response to actuation of the solenoids 520*a* through 520*d*. The bevels also provide the benefit that if two pennies are riding down the rail together, the outer one will fall off when the bevel region is reached. In one embodiment, the thickness of the bottom rail 506*a* is about 0.2 inches (about 0.5 centimeters), and the depth of the bevel 562 is about 0.07 inches (about 1.8 millimeters).

Although the sensor block 502 back rail 504 and bottom rails 506*a*, 506*b*, can be formed of a number of materials, including steel or other metal, resins, composites, and the like, it is preferred, in one embodiment, to form the back rail 504 of a plastic, such as a polyamide polymer, e.g., nylon 66. It is believed that previous devices did not use plastic material for rails or other coin sliding or rolling surfaces because of the fear of unacceptably low durability. However, it has been found that a plastic back rail 506 not only has acceptable durability, but provides the additional benefit that there is a greater tendency in at least some plastic materials (as opposed to many metals) for moisture to bead or otherwise collect, facilitating drainage and removal of moisture from the device. As used herein, "moisture-beading" refers to the tendency of a material to cause water or water vapor to bead, whether from surface tension effects, from the hydrophobic nature of the material or from other causes, and in particular to a tendency to cause beading which is greater than that of steel. This provides a significant benefit since moisture can contribute to coin adhesion or otherwise contribute to slowing or stopping coin movement. Preferably, the sensor block is made from a plastic material. In one embodiment the sensor block is made from a material known as POM Hostaform C9021 EL(Antistatic).

Although the embodiment of FIG. 5 is believed to provide many beneficial results, at least some of the benefits can be obtained using configurations which are modifications of the features shown in FIG. 5. For examnple, the ribs 532, 534 and 536 may be missing in the region of the sensor 514, which may, if desired, be provided with a substantially flat surface. The sensor block 502 and/or back rail 504 may be provided with more or fewer than the depicted three ribs. Some or all of the ribs can be inclined with respect to surface 538. In the depicted embodiment, the thickness 566 of the ribs are relatively small, such as about 0.08 inches (about 2 millimeters), although thicker or thinner ribs can be provided. Preferably, the ribs have a rounded cross-sectional profile, rather than defining right angles or sharp corners on a coin contact surface. Providing a rounded profile is believed to be useful in avoiding slowing or stopping of coin movement which can result form interaction of angles or sharp corners of a rail with nicks, cuts, burrs, or other deformations or imperfections in a coin. Preferably, the contact regions of the solenoids or other components which may contact a coin are sanded or otherwise smoothed and/or rounded to avoid similar slowing or stopping of coins.

In one embodiment, a rail such as that depicted in FIGS. 5 and 6 forms all or part of an identifier 714. In this embodiment the identifier 714 provides data to the counter computer 718 from which the presence of various types of errors, including errors indicative of a coin jam are detected.

A number of types of errors may be detected by or for the counter computer 718. Input or output signals which do not correspond to a signal which is identified or identifiable to the host computer 742, can generate an "unknown" error. Failure of a signal intended to be input to the host computer 742 to reach the host computer 742 or of a signal intended to be output from the host computer 742 to reach its destination (e.g., detected by lack of a "acknowledge" or other response) can generate a "communications" error. Generation of a request or other signal to the counter computer 718 for a feature which is known but not implemented or a command from the counter computer 718 to a component which is recognized but not implemented can result in an "uninstalled feature" error. Failure to load or receive programming or other instructions from the EEPROM 719 can result in an "uninitialized EEPROM" 719 error.

One type of coin handling error is referred to as a "rail stop" which typically means that coins or other objects are at least temporarily stopped or slowed anywhere along the rail 510 including slowing or stoppage along the extent of the block 502, and/or sensor 514, and/or along the extent of the bottom rail 506*a*, 506*b* and/or back rail 504. The presence of this type of error can be detected in a number of ways. In one embodiment, the hopper exit (not shown), the knives 522*a*, 522*b* and the knock off's 520*a*, 520*b*, 520*c*, 520*d* are maintained at a first electrical potential such as about +5 volts, while at least the immediately preceding upstream and immediately succeeding downstream portion of the coin path, and preferably substantially the entire remaining portion of the coin path, is at a second electrical potential, such as ground potential. Thus, if a coin or other at least partially conducting object is positioned touching both the rail and an upstream or downstream portion of the coin path, there will be a short between the (charged) coin path and the (grounded) remainder of the rail. Thus, detection, of a drop in the voltage of the coin path can be taken as an indication of a short between the rail and the upstream or downstream coin path. In many embodiments a short which is very brief in duration is normal and expected, as coins momentarily form a short when they travel from the upstream coin path onto the rail. In one embodiment, a rail stop error is detected only if there is a short which persists for more than a predetermined minimum time, such as about 0.75 seconds (or which results in a more than predetermined decrease in rail voltage).

A number of conditions can be used as indications of a type of coin jam referred to as a "dirty coin" jam. (Even though the jam can occur from causes other than a dirty coin). For example, in the embodiment depicted in FIG. 5 it may be desired to issue a dirty coin error if the sensor 514 is blocked (i.e. senses proximity of a coin for longer than a predetermined period of time), if it is sensed that the coin diameter is too large or to small for any of the coin sizes which are acceptable, if the presence of a coin is detected at a time when no coin should be present in front of the sensor, or if another physical coin parameter or property is outside the predefined expected range, or if the sensors which indicate that there is no coin present provide an unstable or variable output. In the apparatus depicted in FIG. 5 it is possible to use the same "dirty coin" indicators as discussed above in connection with FIG. 6 and/or additionally to use an indication that there is too long a delay in the movement of the coin from an upper position 514 to a lower position 516 (so-called "slow coin problem"), an incorrect "X solenoid count" (i.e. the count of coins that have passed the main sensor does not match the count of coins that have passed the X sensor, becomes negative or is greater then the physically possible maximum) an indication that the X sensor 516 is blocked (i.e. senses a coin proximity for more than a predetermined period of time), or dirty (i.e. the difference in the analog reading when blocked and that when not blocked is too small to be useful). Although these examples are sufficient to provide those with skill in the art with items which may be used to indicate the dirty coin problem, other indicators of dirty coin problems can also be used as will be apparent to those with skill in the art after review of the present disclosure.

Figure 1:
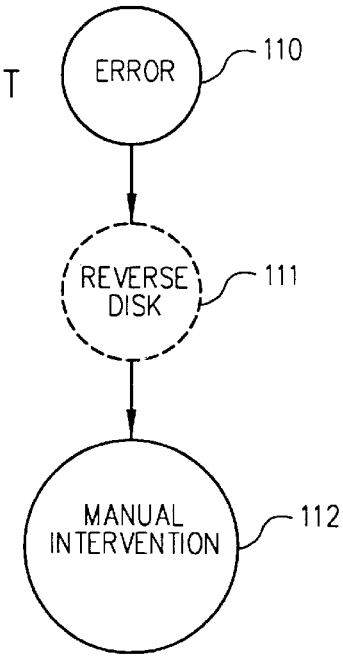
FIG. 1 PRIOR ART
FIG. 1 is a flow diagram of responding to a detected error according to certain previous devices.

Many previous devices responded to the detection of a coin jam or similar error 10 as depicted in FIG. 1 by requiring manual clearing of the jam or other manual intervention 112. Such requirement for manual intervention is undesirable, particularly in the context of a coin handler intended for automatic and/or retail consumer use, for the reasons described above. In some devices, such as disk-fed or other driven devices, the disk or other drive device was reversed 111. However, reversal of a drive device is a limited response to a jam and in particular is of no avail in gravity fed (or partially gravity fed) devices since gravity can not be reversed.

Figure 2:
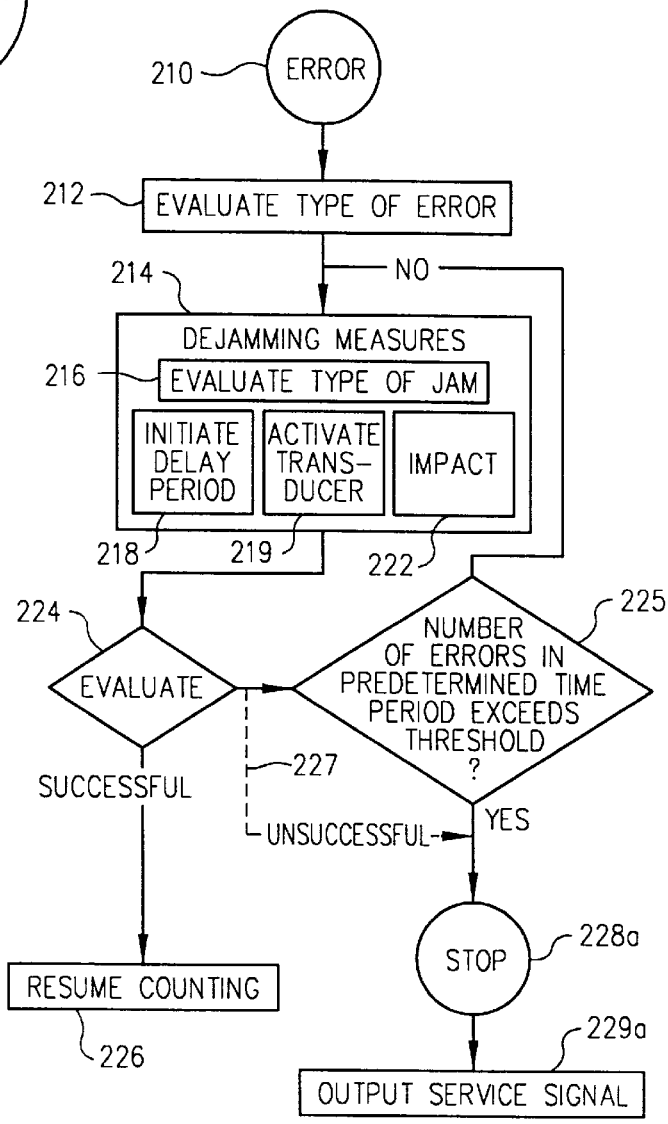
FIG. 2 is a flow diagram, in overview, of an error detection response according to an embodiment of the present invention.
Figure 4A:
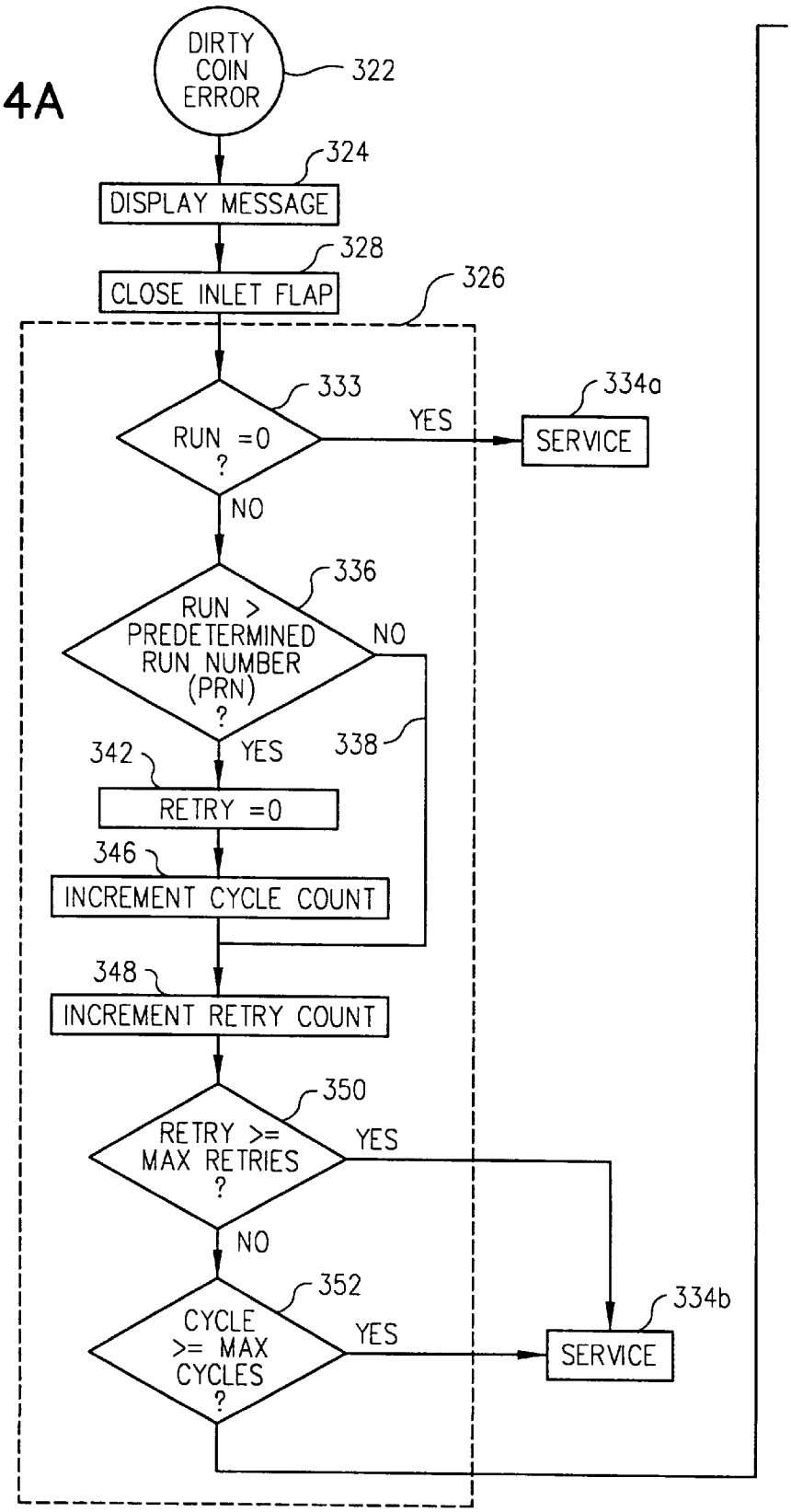
FIG. 4A–4C are a diagram of a dirty coin error routine according to an embodiment of the present invention.
Figure 4B:
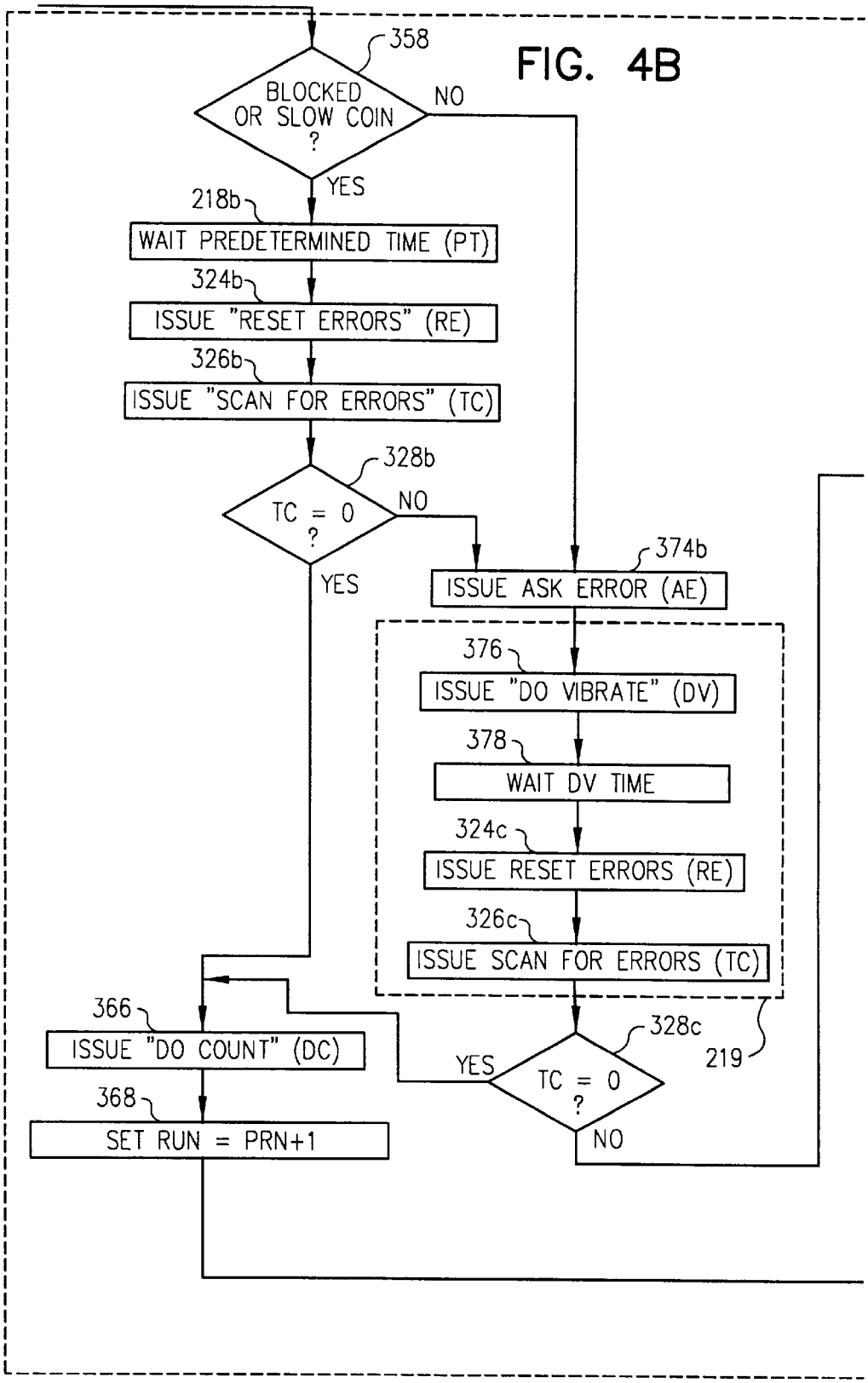
Figure 4C:
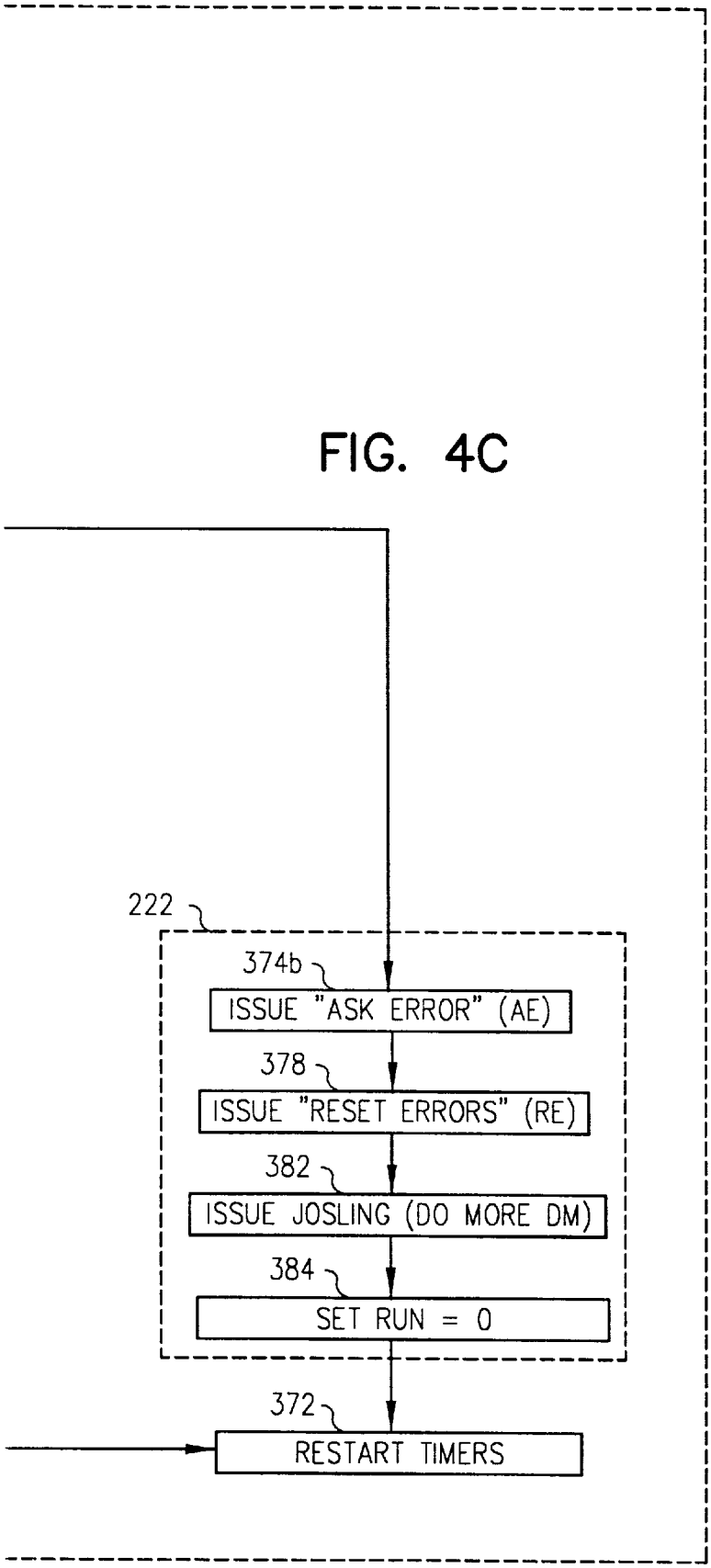

FIG. 2 provides an overview of a dejamming process according to one embodiment of the invention. In the embodiment depicted in FIG. 2 the process begins when an error is detected, such as by receiving or generating an error message by the counter computer 718. In the depicted embodiment, the type of error is then evaluated 212. This step is provided since there may be some types of errors which are not coin jam errors and for which dejamming measures are not necessary (as described more fully below). In the depicted embodiment if dejamming measures are undertaken 214 one embodiment includes a process of evaluating the type of jam 216. This process is provided in situations where the particular type or types of dejamming measures to be taken depend on which type of jam is detected. As described more thoroughly below, in one embodiment, one or more types of dejamming measures are undertaken fox a rail stop jam, while other, possibly partially overlapping, measures are taken in response to a dirty coin jam.

A number of types of dejamming measures can be undertaken. Examples include initiating a predetermined delay period 218, i.e. period during which measures are not taken to provide impact or mechanical energy to the area of the jam and during which, preferably, coin flow into the area of the jam is suspended. Without wishing to be bound by any theory, it is believed that providing a delay period of this nature is useful since some types of jams will clear themselves with passage of sufficient amount of time, and such clearage might be interrupted or inhibited by taking actions such as providing mechanical energy or impact.

Another dejamming measure is to provide mechanical energy to the region of the jam, such as by activating one or more transducers, e.g. a rail solenoid or other transducer 219. Although it is possible to design a coin counter or handler which includes a transducer whose only function is for dejamming, in one embodiment it is preferred to make use of a transducer which is already present in a device for another purpose, such as one or more of the rail solenoids.

Another measure is to provide impact of an object or item with the area of the jam, preferably, impacting the coin or other object which is the source of cause of the jam 222. In one embodiment, this is accomplished by forcing the flow of one or more coins onto the rail 510, 506*a*, 506*b* which may result in "knocking loose" a stuck coin or other object. It is believed previous approaches to dejamming avoided introducing coins into the area of the jam, principally because of fears of creating an inaccurate count.

In one embodiment of the invention, before, during or following the dejamming measures 214 an evaluation is performed to determine whether previous dejamming measures were successful or unsuccessful 224. In the depicted embodiment, an evaluation that dejamming was successful results in resumption of normal coin handling, counting or other processing 228.

Although it is possible to provide an evaluation process 224 which makes a simple determination of whether the apparatus is currently in a jammed or unjammed condition, and, issues a stop 228*a* and service signal or request 229*a*, in response to an "unsuccessful" determination 227 (depicted in phantom), it is preferable, in one embodiment, to provide a more sophisticated evaluation. A more sophisticated evaluation can be used to avoid problems that may occur if a simplified evaluation measure is used. One such problem arises when the items being processed are extremely dirty, misshapen, or otherwise give rise to a large number of jams. Using a simplified evaluation procedure, a situation could arise in which dejamming measures 214 were instituted every few coins or even every coin, which would cause a long delay in processing an entire batch of coins, possible count discrepancies and/or an inordinate number of rejected coins and customer dissatisfaction.

In one embodiment of the present invention, the evaluation step 224 includes storing and/or making use of data which indicates the jamming history for this batch of coins. Although, for purposes of discussion, FIG. 2 depicts the evaluation step 224 as occurring after the dejamming measure 214 as described more thoroughly below, in at least some embodiments, some or all of the evaluation step 224 can be performed prior to some or all of the dejamming measures 214. In general, the more sophisticated type of evaluation can include a determination of whether too many errors have occurred in a relatively short period of time 225. If so, the stop 223*a* and service signal 229*a* commands can be issued. If not, the routine can return to the dejamming procedures 214. For example, and as described more fully below, the decision regarding whether to resume counting or to stop depends on whether the error 210 is considered to occur during a period of recent jams (referred to as being "in the woods" or ITW). In one embodiment, once a dirty coin is detected, the machine is indicated as being in an ITW condition until at least a predetermined period of time has passed (or a predetermined amount of data has been processed) without further errors. In one embodiment, if there are three dirty coin errors detected during a single ITW, and, during the same ITW episode, a fourth attempt is unsuccessful, the procedure will issue a stop 223*a* and request for service 229*a*.

FIG. 3 depicts an error handling procedure according to one embodiment of the present invention. Although in the following discussion, many tasks, including tasks of scanning or evaluating data for indications of errors, are described as being performed by the computer, it is possible also to provide hardware, logic and/or one or more processors as part of the coin handling or processing device for components thereof for performing these or similar tasks. As depicted in FIG. 3, following an error 210, it was first determined, e.g., by the host computer 742 whether the error is an "unknown", "communications" or "uninstalled features" error 310 and, if so, the procedure stops in the depicted embodiment. In another embodiment, errors of this type are logged and coin counting or processing continues. Next in priority is a handling of an uninitialized EEPROM error 314 which causes the issuance, e.g., by the host computer 742 of a stop command 228*c* and 229*c*. It is then determined whether the error is a rail stop error 318. If it is not a rail stop error, it is determined whether it is a dirty coin error 320 and if so, the dirty coin procedure is initiated 322 described more thoroughly below.

If it is determined that a rail stop error has occurred, in the depicted embodiment a wait or delay period of a predetermined duration (PRP) is initiated by the host computer 742. The length of the rail stop delay can be determined empirically, if desired. In one embodiment, the rail stop delay (PRP) equals about one second. After the delay period, the "errors" indicators are reset 324*a*, i.e. the registers or other devices for holding error indications in the counter computer 718 are cleared so that, thereafter, any error indications will be new indications. The device then scans for errors again 326*a* such as by issuing one or more commands from the counter computer 718 to the coin handler and/or various components thereof, to output data from sensors from which error conditions can be evaluated. It is then determined, e.g., by the host computer 742, whether, as a result of the scan 326*a* there is still an indication of an error 328*a*. If not, counting processes are restarted 226. However, if there is still an error, it is determined whether the error now being indicated is a rail stop error 332. If it is not a rail stop error, the normal counting process 226 continues (including error handling processes, for handling the type of error which is now being asserted.) However, if the error which is present after the dejamming measure 218 and evaluation 224 is a rail stop error, then a stop command 228*a* is issued by the host controller 742. The host computer 742 may cause a signal to be output to notify personnel that manual intervention is needed.

It will be noted that, in this embodiment, the response to a rail stop does not include attempting to impact the jam site with additional coins or other items 222. Although this is a possible response to a rail stop error, it is preferable not to provide this response to a rail stop error since it is believed that in, many cases, pushing additional coins down the rail can result in miscounts and/or lost coins. Further, it is believed that a significant number of rail stop errors occur at the exit of the hopper and, in this condition, it is possible for activation or turning of the hopper to cause damage to the hopper, the rail or other components. However, it is also possible to use other dejamming measures in response to a rail stop, including measures such as those described below or measures taken in response to a dirty coin error, which may or may not include impact 222.

Figure 4:
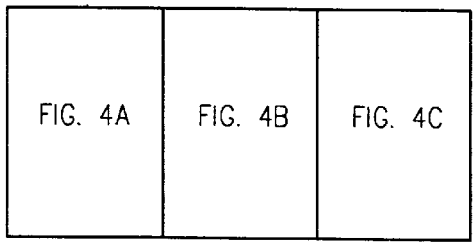
FIG. 4 is a diagram showing the arrangement of FIGS. 4A–4C.

FIG. 4 depicts a dirty coin procedure according to one embodiment of the present invention. In this embodiment, after it is determined that the error is a dirty coin error, the host computer 742 may optionally display a message 324. The message may be a message intended to reassure the customer, since the response to the dirty coin error may require some amount of time and/or may involve generation of a different level of sound or noise from the machine.

In the depicted embodiment, the host computer 742 then issues a command which causes the inlet flaps to the hopper 712 to close 328 thus stopping further flow of coins from the coin input area 710 to the hopper 712.

In the depicted embodiment, the following procedures can be generally considered in two categories, the procedures involved with determining whether the machine is in an ITW condition 326 and providing appropriate responses to such determination, and, where appropriate, performing one or more dejamming measures 214.

Before describing the steps in the ITW procedure 326 it will be useful to describe the use and meaning of some of the variables or parameters employed in the procedure. The parameter named "run" is a variable containing the number of data packets that have been continuously processed, without generation of an error message. This can be used to, e.g., determine whether the machine has gone without an error for a sufficiently long period of time that it can be now declared no longer in an ITW condition. The run variable also can be used to indicate that the most recent dejamming attempt was unsuccessful, i.e. that despite the dejamming measures, the machine is still in a jammed state. In the depicted embodiment this is indicated by a value of 0 for the run variable.

Another variable is named "retry". This variable stores the number of errors that have been generated in the current ITW state.

Another variable in the depicted embodiment is named "cycle". This variable stores the cumulative number of times that an error has been generated during the time when the machine is in an ITW condition (i.e. any ITW condition, not necessarily only during the present ITW condition).

In the depicted embodiment, it is determined whether the value of the "run" parameter is 0 333. As described above, a value of 0 indicates that there is an immediately-preceding dejamming measure which was unsuccessful. The setting of run=0 is described more thoroughly below. In this situation, it is apparent that the dejamming measures were not successful, and in the depicted embodiment the apparatus outputs a signal requesting service, such as manual intervention 334*a*. If the run variable is not 0, it is determined whether the run variable is greater than a predetermined run number (PRN) 336. Since the run variable indicates the number of "clean" data packages (i.e. the number of items that have been processed by the coin counter or handler without generating an error) this decision is used to determine whether a new ITW condition can be declared. The value of PRN can be selected empirically if desired. In one embodiment, the PRN is equal to four, which, under normal conditions for at least one apparatus used in connection with this invention, corresponds to a time period of approximately two seconds or roughly 20 coins.

If the value of "run" is sufficiently high, a procedure for declaring the device as in a new "ITW" condition is undertaken, whereas if "run" is not at least equal to this threshold, these procedures will be bypassed 338. The declaration of a new ITW involves setting the "retry" variable to 0 342, which will mean that, on the next dirty coin error the retry variable will begin counting from zero, i.e., will hold the number of errors detected in the ITW condition. The cycle count is incremented 346 to reflect the total number of errors that have occurred during an ITW condition. Next, the "retry" count is incremented, which provides a count of the number of errors that have occurred in the current "ITW" condition. It is then determined by the host computer 742 whether this number exceeds a predetermined maximum value 350. This essentially establishes the maximum number of errors that can be tolerated in a given ITW condition. If this maximum number is exceeded, a service call is issued 334*b*. The maximum retry value can be established empirically, if desired. In one embodiment, the value of maximum retries is 5. If the maximum number of errors in the current ITW session has not been exceeded, it is then determined whether the maximum number of errors that have occurred overall, during any ITW condition (not just the current ITW condition) occurring in the current transaction exceeds a predetermined value, which is here named "max cycles". If this number is exceeded, a service call is issued 334*b*. The max cycles valve can be determined empirically if desired. In one embodiment max cycles is equal to three. If none of the conditions resulting in a service call 334*a*, 334*b* are dejamming measures 214 are undertaken.

Although in the depicted embodiment, some amount of type-of-jam evaluation 216 has been conducted at this point, preferably additional evaluation providing more refined response to a jam can also be performed, such as determining which type of dirty coin error has occurred. In the depicted embodiment, the types of dejamming measures are different depending on whether or not the type of jam is an "X blocked" or a "slow coin" type of jam 358. If it is an X blocked or slow coin type of jam, in the depicted embodiment, a delay procedure 218*b* is performed, whereas if it is some other type of dirty coin error, the wait procedure 218*b* is bypassed 362.

If the wait procedure 218*b* is performed, it may differ from the rail stop procedure 218*a*, e.g., by being performed for a different period of time PT. The value for PT can be determined empirically, if desired. In the depicted embodiment, PT is set equal to about 2 seconds. Following the wait period 218*b* the error indicators are cleared 324*b* and the host computer 742 issues an instruction to the counter computer 718 to scan for current error conditions or indications 326*b*. If the instruction returns a 0 value (indicating that there are currently no errors detected) 328*b*, then it appears that the dejamming procedure of initiating a wait period was successful. A Do Count (DC) instruction is issued 366 to start counting coins and the "run" variable is set equal to one greater than the predetermined run number PRN 368. Because of this step 368 the next succeeding error which occurs will cause the ITW procedure 326 to handle the error as if the machine has been trouble-free for at least the predetermined number of data packets or period of time, as discussed above. The host computer 742 then restarts the various timers used to control the process 226 and counting is begun in the normal fashion.

If, following the wait procedure 218*b* it is found that there is still an error indicated 328*b*, or if the error was an X blocked or slow coin error 358, then an activate transducer measure 219 is undertaken. In the case of reaching the activate transducer procedure 219 following a wait procedure 218*b* the host computer 742 will first issue an Ask Error (AE) command 374*b* for the purpose of logging the current number of errors. This is similar to the TC instruction noted above, except that it does not rescan the hardware, but merely returns the current (stored) indications of errors.

As part of the activate transducer procedure 219 the host computer 742 outputs a "do vibrate" (DV) command 376. In response to this command, one or more of the transducers in the machine are activated. Preferably, as described above, the activated transducers include solenoids which are present in the region of the jam, and preferably solenoids which are present for performing other purposes as well. Preferably the transducers are activated repeatedly and at a relatively high frequency, such as about fifty times per second, for at least a predetermined period of time such as about 4 seconds (DV time). Such activation of transducers results in setting up mechanical energy such as vibrations in the rail 510 and adjacent regions which may result in dislodging or otherwise move a slow or stuck coin or other object. Simultaneously, a wait is performed, preferably for a period about equal to the DV period, so that the host computer 742 will wait for the vibration to end before proceeding. Following the vibration and wait period 378 the error register or indicator is cleared 324*c* the host computer 742 issues a command to scan for current errors 326*c*, 328*c*. If, at this point, there are no current errors detected, the procedure follows a path similar to that following a no-error determination after a wait period 218*b*, i.e. issuing the DC command 366 setting run equal to PRN plus 1 368 restarting timers 372 and resuming normal counting or handling procedures. However, if following the transducer activation 219 there is still an error, then a jostling or impact measure 122 is initiated. In this procedure, after issuing an Ask Error (AE) command 374*b* and also issuing an Reset Errors (RE) command 378 for the purpose of clearing any pending error, the host computer 742 issues a command to initiate impact or jostling which, in one embodiment, is referred to as a Do More (DM) command 382. As a result of this command, one or more coins or other items are introduced onto the rail. In some previous devices, the system was configured to prevent introduction of coins onto the rail when there was a pending indication of an error. According to one aspect of the present invention, coins can be introduced onto the rail despite the fact that there is a pending indication of an error i.e., in this embodiment of the invention, the lock-out mechanism and/or software is overridden and coins are introduced onto the rail, 510, e.g., from the hopper, such as by forcing the hopper to turn preferably simultaneously with vibration, e.g., as previously described. After being introduced onto the rail, the coins travel down the rail in the normal fashion and will typically impact any coin or other object which is stopped or slowed on the rail. Preferably one or more of such jostling or impact incidents combined with vibration will dislodge or otherwise move the stuck or slow coin. The period of time during which impact or jostling takes place can be determined empirically, if desired. In one embodiment, jostling occurs for a period of approximately two (2) seconds. The variable "run" is then set to 0 (indicating that the jostling was unsuccessful), so that if another error occurs after exiting procedure 222, the "run=0" condition 333 will be positive and this will result in a service call 334*a*. In one embodiment, during an impact or jostling procedure, the apparatus is configured to direct all coins which are placed onto the rail to the return bin 720. This, in one embodiment, involves pulsing a reject solenoid, which preferably also provides some vibration during this procedure. It is desired to reject all coins introduced onto the rail during a jostling procedure because, owing to the stuck or slow coin problem, the coins on the rail may not be moving fast enough to provide a proper count, or there may be other types of problems such as overlapping of coins at the sensor, and the like. For reasons such as these, the standard reject procedure does not work. Instead, according to an embodiment of the present invention, the reject solenoid 516' is controlled to pulse at a high frequency. Thus, because of the potential for inaccurate counting or handling, preferably all such coins used during the jostling or impact procedure are returned to the user. It is believed that in some of the installed base of coin counters, sorters and/or handlers, the devices are not configured to initiate a desired type or amount of mechanical energy, such as by repeated or simultaneous activation of transducers and, in these types of devices, it may be necessary to modify the hardware and/or software in the counter to achieve the desirable type, amount or duration of mechanical energy.

In light of the above description, a number of advantages of the present invention can be seen. The coin handler is practical for unattended use (such as by the ordinary untrained consumer) since jams, which can lead to customer dissatisfaction and/or mistrust, are reduced, eliminated and/or automatically fixed. The need for manual intervention, e.g. by on-site personnel, is reduced or eliminated. The device requires less maintenance. The method and apparatus of the invention is easily adaptable to provide these benefits in connection with may types and styles of coin counter, often with little or no additional hardware, and is easily adaptable to different types of coins (different countries and/or denominations or different coin designs and characteristics).

A number of variations and modifications of the invention can be used. It is possible to use some aspects of the invention without using other aspects. For example, it is possible to use some or all of the disclosed dejamming methods without using some or any of the disclosed rail devices, configurations, materials and/or methods. it is possible to use, e.g., the vibration dejamming measure without using the disclosed evaluation procedure. It is possible to use the disclosed rail configuration made of materials other than those disclosed. Although the two computing devices are disclosed, it is possible to use only a single computer and/or to provide some or all of the logic in a hard-wired and/or discrete fashion, such as using an application specific integrated circuit (ASIC) or other non-software-controlled device. For example, the control and decision procedures which are disclosed can be performed by a plurality of discrete AND, OR and NOT gates. The invention can be used in connection with belt-driven, rotary or other coin conveying apparatus. The dejamming methods and apparatus can be used in connection with devices intended to perform any or all of counting, sorting, rolling or otherwise packaging coins and can be used in conjunction with other operations such as coupon and/or voucher dispensing.

Although the present application has been described by way of preferred embodiments and certain variations and modifications, other variations and modifications can also be used, the invention being defined by the following claims.

What is claimed is:

1. In a coin counter having a first rail for conveying coins along a path from an entry point to at least a first sensor, apparatus comprising:

a first region of said rail defining a first surface with a longitudinal extent from said entry point to at least said first sensor for contacting an edge of said coins;

a second region of said rail having a plurality of ribs positioned substantially non-movably with respect to said first surface at levels vertically above a level of an adjacent portion of said first region for supporting a face of said coins said plurality of ribs having a substantially non-flat coin contact surface;

said ribs extending longitudinally substantially parallel to at least a portion of said longitudinal extent of said first surface, said ribs protruding in a non-vertical direction, to define a rib depth, said non-vertical direction being substantially parallel to an adjacent portion of said first surface wherein a first of said ribs extends a first distance longitudinally along said rail from a first start point on an entry point side of said sensor to a first end point on a side of said sensor opposite said entry point side, wherein a second of said ribs extends a second distance longitudinally along said rail from a second start point on an entry point side of said sensor to a second end point on a side of said sensor opposite said entry point side, and wherein said first end point and said second end point are not aligned in a vertical direction.

2. Apparatus, as claimed in claim 1, wherein at least one of said plurality of ribs contacts a face of a coin to define a contact ratio such that the length of the rail in contact with the face of the coin is less than about two thirds the diameter of the coin.

3. Apparatus, as claimed in claim 2, wherein said at least one of said plurality of ribs is substantially adjacent an edge of said coin.

4. Apparatus, as claimed in claim 1 wherein said second region of said rail comprises a non-metallic material.

5. Apparatus, as claimed in claim 1 wherein said second region of said rail comprises a plastic.

6. Apparatus, as claimed in claim 1 wherein said second region of said rail comprises a substantially moisture-beading material.

7. Apparatus, as claimed in claim 2, wherein said plurality of ribs have a depth greater than about 0.005 inches.

8. Apparatus, as claimed in claim 1, wherein said first start point and said second start point are not aligned in a vertical direction.

9. Apparatus, as claimed in claim 1, wherein at least said first and said second of said plurality of ribs extend at least to said first sensor, and wherein at least a third of said plurality of ribs terminates substantially short of said first sensor.

10. Apparatus, as claimed in claim 1, further comprising means, in said second region, for reducing the slowing or stopping of coin movement along said rail.

11. Apparatus, as claimed in claim 1, wherein a first portion of said first surface of said first region has a first horizontal extent, wherein a second portion of said first surface has a second horizontal extent, and wherein said first horizontal extent is greater than said second horizontal extent.

12. In a coin counter having a first rail for conveying coins along a path from an entry point to at least a first sensor, apparatus comprising:

means, in said rail for contacting an edge of said coins such that said coins are in a substantially non-horizontal attitude, wherein said means for contacting defines a first surface with a longitudinal extent from said entry point to at least said first sensor;

plurality of rib means, positioned substantially non-movably with respect to and vertically above said means for contacting for supporting a face of said coins in a non-horizontal attitude, said plurality of rib means having a substantially non-flat coin-contact surface, a first of said plurality of rib means extending longitudinally substantially parallel to at least a portion of said longitudinal extent of said means for contacting to a first point on a side of said sensor distal from said entry point and a first distance from said sensor, a second of said plurality of rib means extending longitudinally substantially parallel to at least a portion of said longitudinal extent of said means for contacting to a second point on a side of said sensor distal from said entry point and a second distance from said sensor, wherein said first distance is not equal to said second distance, said ribs protruding in a non-vertical direction to define a rib depth, said non-vertical direction being substantially parallel to an adjacent portion of said means for contacting.

13. Apparatus, as claimed in claim 12, wherein at least one of said plurality of rib means contacts a face of a coin to define a contact ratio such that the length of the rail in contact with the face of the coin is less than about two thirds the diameter of the coin.

14. Apparatus, as claimed in claim 13, wherein said at least one of said plurality of rib means is substantially adjacent an edge of said coin.

15. Apparatus, as claimed in claim 12 wherein plurality of rib means comprises a non-metallic material.

16. Apparatus, as claimed in claim 12 wherein said plurality of rib means comprises a plastic.

17. Apparatus, as claimed in claim 12 wherein said plurality of rib means comprises a substantially moisture-beading material.

18. Apparatus, as claimed in claim 12, wherein at least one of said plurality of rib means has a depth greater than about 0.005 inches.

19. Apparatus, as claimed in claim 12, wherein at least one of said plurality of rib means has a longitudinal extent substantially less than that of another of said plurality of rib means.

20. Apparatus, as claimed in claim 12, wherein at least said first and said second of said plurality of rib means extend at least to said first sensor, and wherein at least a third of said plurality of rib means terminates substantially short of said first sensor.

21. Apparatus, as claimed in claim 12, wherein a first portion of said means for contacting has a first portion having a first horizontal extent, wherein a second portion of said means for contacting has a second portion having a second horizontal extent, and wherein said first horizontal extent is greater than said second horizontal extent.

22. In a coin counter having a first rail for conveying coins along a path from an entry point to at least a first sensor, a method comprising:

contacting an edge of said coins with a first region of said rail defining a first surface with a longitudinal extent from said entry point to at least said first sensor;

contacting a face of said coins with a plurality of ribs positioned substantially non-movably with respect to said first region at levels vertically above a level of an adjacent portion of said first region, said plurality of rib means having a substantially non-flat contact surface, a first of said ribs extending longitudinally substantially parallel to at least a portion of said longitudinal extent of said first region to a first point on a side of said sensor distal from said entry point, a second of said ribs extending longitudinally substantially parallel to at least a portion of said longitudinal extent of said first region to a second point on said side of said sensor distal from said entry point, said ribs protruding in a non-vertical direction to define a rib depth, said non-vertical direction being substantially parallel to an adjacent portion of said first region and wherein said first point and said second point are not aligned in a vertical direction.

23. A method, as claimed in claim 22, wherein said step of contacting a face of said coins comprises contacting a face of said coin with at least one of said plurality of ribs to define a contact ratio such that the length of the rail in contact with the face of the coin is less than about two thirds the diameter of the coin.

24. A method, as claimed in claim 23, wherein said at least one of said plurality of ribs is substantially adjacent an edge of said coin.

25. A method, as claimed in claim 22, wherein a first portion of said first surface has a first horizontal extent, wherein a second portion of said first surface has a second horizontal extent, and wherein said first horizontal extent is greater than said second horizontal extent.

* * * * *